United States Patent [19]

Lanius et al.

[11] Patent Number: 4,775,199

[45] Date of Patent: Oct. 4, 1988

[54] TOOL BOX

[75] Inventors: Charles A. Lanius, Prairie du Sac, Wis.; Yefim Gurevich, Willoughby Hills, Ohio

[73] Assignee: Flambeau Corporation, Baraboo, Wis.

[21] Appl. No.: 79,350

[22] Filed: Jul. 30, 1987

[51] Int. Cl.[4] ..... E05C 7/06

[52] U.S. Cl. ..... 312/220; 312/216; 312/DIG. 33

[58] Field of Search ..... 312/290, DIG. 33, 216–222, 312/311; 220/335

[56] References Cited

U.S. PATENT DOCUMENTS

| | | | |
|---|---|---|---|
| 106,970 | 8/1870 | Titus | 312/220 |
| 697,614 | 4/1902 | Fergusson | 312/220 |
| 851,357 | 4/1907 | Keefe | 220/335 |
| 898,106 | 9/1905 | Higgins | 312/220 X |
| 1,459,324 | 6/1923 | Diebold | 312/290 X |
| 1,984,345 | 12/1934 | Kennedy | 312/290 |
| 2,164,133 | 6/1939 | Efron | 312/290 X |
| 2,286,427 | 6/1942 | Levensten | 312/290 X |
| 3,316,045 | 4/1967 | Leland | 312/220 |
| 3,893,740 | 7/1975 | England | 312/216 |
| 4,308,972 | 1/1982 | McReynolds et al. | 220/335 |
| 4,696,412 | 9/1987 | McGawan et al. | 220/335 |

*Primary Examiner*—Joseph Falk

*Attorney, Agent, or Firm*—Allegretti & Witcoff, Ltd.

[57] ABSTRACT

The present invention relates to a plastic tool box having a locking mechanism for the lid and drawer. When the locking mechanism is in the unlocked position, the drawer may be opened regardless of lid position; when the locking mechanism is in the locked position, the drawer may be opened only when the lid is open.

11 Claims, 4 Drawing Sheets

TOOL BOX

BACKGROUND OF THE INVENTION

The present invention relates generally to boxes, chests or other containers particularly adapted for use in storing and transporting tools and the like. More specifically, this invention relates to a molded plastic tool box of the type having a one or more storage drawers in its front, an upper open end, and a hinged lid adapted to overlie and cover the upper open end of the box. Such a molded plastic box could, of course, also be used to store and transport items other than tools, for example, fishing equipment and accessories.

It is known to include a plurality of storage drawers in the fronts of tool boxes and to use hinged lids to cover and overlie the upper open ends of tool boxes. Similarly, prior tool boxes have included a variety of different mechanical devices for locking the storage drawers in their closed positions. Generally, these prior drawer locking devices have been interconnected with the lid of the box so that when the lid is closed, the locking devices prevent the storage drawers from being opened.

In many instances, the inability to be able to open drawers with the lid closed is a serious, practical disadvantage. It is often cumbersome and quite bothersome for a busy workman to have to first open the lid each time he wants to have access to the contents of a storage drawer of his tool box.

Additionally, prior tool boxes have included straps or other linkages that interconnect the lid with the body of the box. These straps and other linkages serve to limit the angle through which the lid may be opened and sometimes are utilized to retain the lid in its open position.

SUMMARY OF THE INVENTION

In principal aspect, the present invention comprises an improved molded plastic box especially adapted to transport and store tools and the like. This improved tool box has a plurality of storage drawers in its front and an upper open end. It includes a molded plastic lid that is hinged to the body of the box and that when closed, is adapted to overlie and cover the open upper end of the box and when opened, to permit ready access to the interior of the box. The improved molded plastic tool box of the present invention also includes a novel, molded plastic locking assembly. When moved to its unlocked position, this locking assembly affords the advantage of permitting the storage drawers to be opened while the lid is closed as well as when the lid is opened. When moved to its locked position, the locking assembly permits the storage drawers to be opened when the lid is in its opened position, but prevents the storage drawers from being opened when the lid is closed.

Another advantage of the improved molded plastic tool box is that the integrally molded hinge on the molded plastic lid includes a projection that cooperates with the body of the box to limit the angle, with respect to the plane of the upper open end of the box, through which the lid may be moved. This angle is predetermined so that when opened, the lid is substantially perpendicular to the plane of the open upper end of the box. Thus even when the lid is open, the box still does not occupy any more space on the tool bench or the like than that required for the box itself. Additionally, the predetermined angle is selected so that the lid will be maintained in an open position without the need to use any additional strap or linkage or to manually hold the lid in its open position.

Accordingly, it is a primary object of the present invention to provide an improved molded plastic box which is specifically adapted to store and transport tools and the like and which includes a novel locking assembly so that when the locking assembly is moved to its unlocked position, the storage drawers may be opened and closed whether the lid is opened or closed and so that when the locking assembly is moved to its locked position, the storage drawers cannot be opened with the lid closed, but may be opened with the lid opened. A related object of the present invention is to provide an improved molded plastic tool box of the type described wherein hinges are formed as an integrally molded part of the lid and wherein the lid's hinges include integrally molded projections that are adapted to contact the body of the box when the lid is moved to its open position and that limit the angle, with respect to the plane of the upper open end of the box, through which the lid may be moved.

Another object of the present invention is to provide an improved molded plastic tool box of the type described wherein the novel locking assembly includes a vertically disposed locking shaft that is disposed in the box adjacent to its rear wall and that carries a locking abutment for each of the storage drawers in the box and wherein each of the storage drawers includes a locking abutment that is adapted to engage and cooperate with the corresponding locking abutment on the shaft when the storage drawer is closed and when the locking assembly is in its locked position. A related object of the present invention is to provide an improved tool box having a locking shaft, as described, wherein the locking shaft may be rotated, about its central longitudinal axis, between a locked position and an unlocked position and wherein the locking shaft may also be moved, up and down, vertically between an upper position and an lower position. A still further related object of the present invention is to provide an improved plastic molded tool box of the type described wherein when the lid is closed and when the locking shaft is rotated to its locked position, a portion of the lid contacts the upper end of the locking shaft and holds the locking shaft in its lower position so that engagement between the locking abutments on the storage drawers and the locking shaft will maintain the storage drawers closed, and wherein when the locking assembly is in its locked position and when the lid is open, pulling a storage drawer open causes the locking abutment on that drawer to move past the corresponding locking abutment on the locking shaft as the locking shaft moves upwardly from its lower position to its upper position. Yet another related object of the present invention is to provide an improved molded plastic tool box, as described, wherein when the locking shaft is moved (that is, rotated) to its unlocked position, the locking abutments on the locking shaft are moved out of engagement with the locking abutments on the storage drawers so that the storage drawers may be opened and closed whether the lid is open or closed.

These and other objects, advantages and features of the present invention will be set forth in the detailed description of the preferred embodiment of the present invention which follows:

BRIEF DESCRIPTION OF THE DRAWINGS

In the detailed description of the preferred embodiment which follows, reference will be made to the drawings comprised of the following figures.

DESCRIPTION OF THE PREFERRED EMBODIMENT

Figure 1:
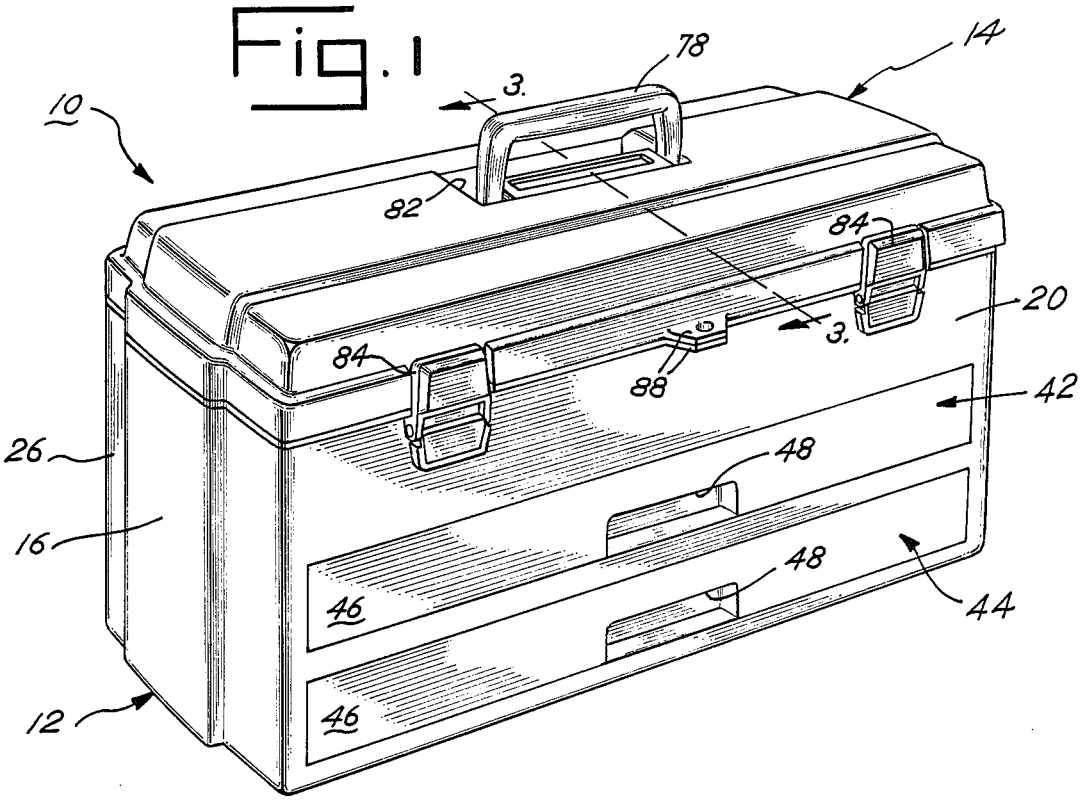
FIG. 1 is a front, perspective view of the improved molded plastic tool box of the present invention where the lid and the storage drawers are shown in their closed positions.

Referring now to FIGS. 1–3 and 9, the preferred embodiment of the improved box of the present invention is shown generally at 10. As noted, box 10 is especially adapted to store and transport tools and the like.

The tool box 10 includes a molded plastic body 12 and a molded plastic lid 14. Both the body 12 and the lid 14, and their component parts, hereinafter described, are made by conventional injection molding techniques.

The body is comprised of integral side walls 16 and 18, a front wall 20, a bottom wall 22, and a rear wall 24. A piece, indicated at 26, of the rear wall 24 is formed separately from the rest of the body. The bottom and side portions of this rear wall piece 26 extend forwardly so that their distal edges overlap with the adjacent, rearwardly directed edges of the bottom wall 22 and the side walls 16 and 18. The rear wall piece 26 is secured, about its edges, to the bottom wall 22, the side walls 16 and 18, and the rear wall by conventional rivets, not shown. The rear wall piece 26 is formed separately so as to facilitate assembly of the tool box 10 as hereinafter described.

Figure 2:
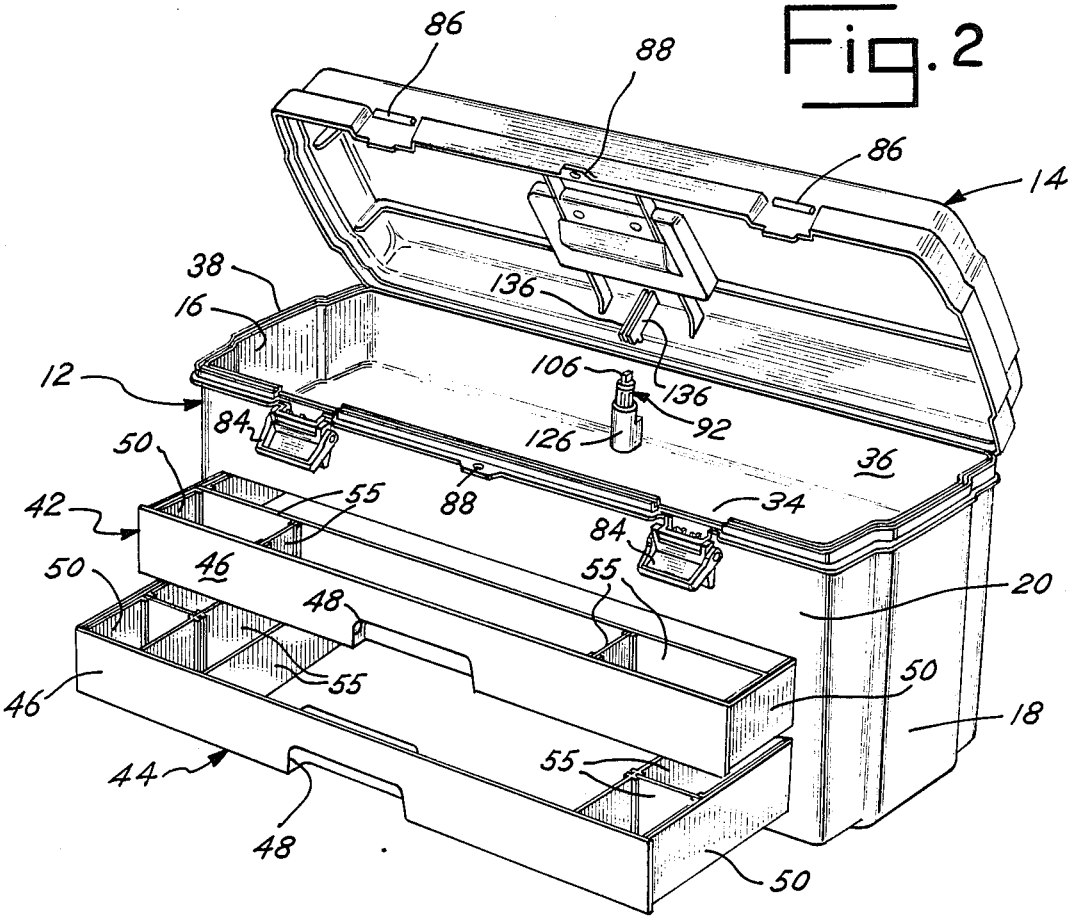
FIG. 2 is another front, perspective view of the improved tool box of the present invention where the lid and the storage drawers are shown in their opened positions.
Figure 3:
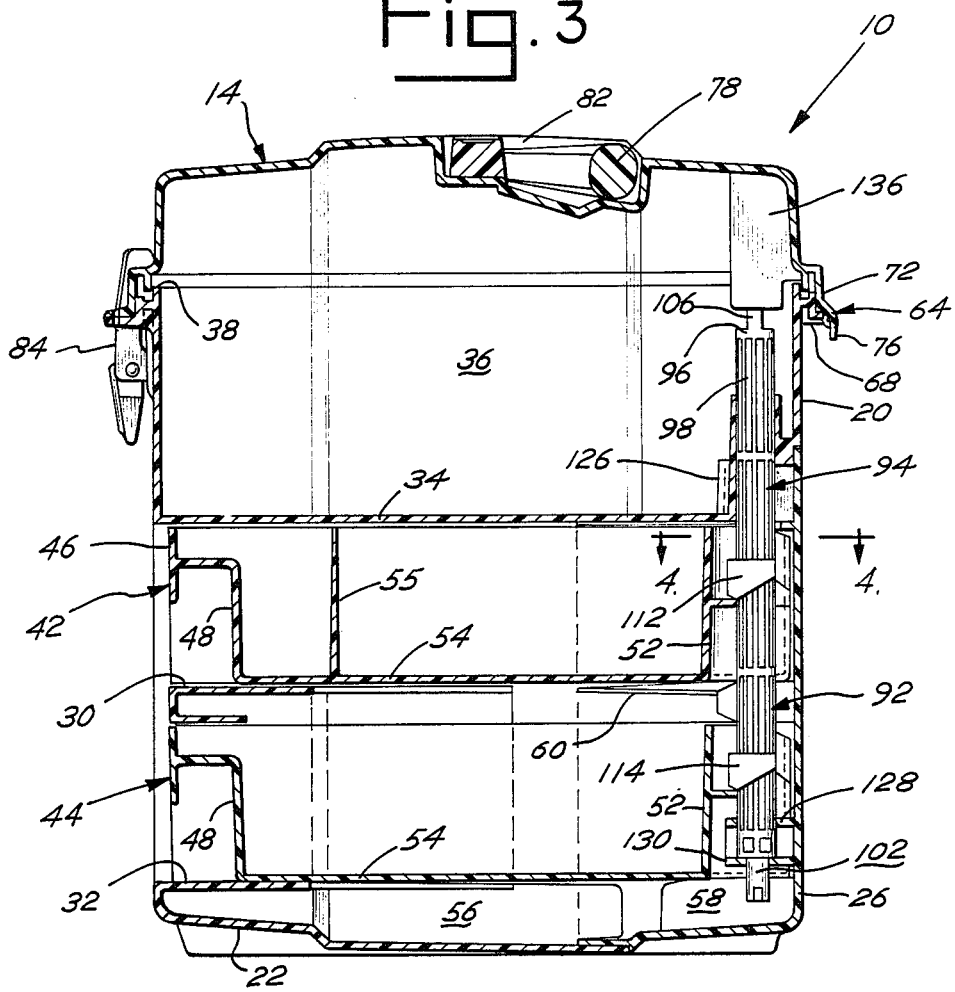
FIG. 3 is a cross-sectional view taken along the line 3—3 in FIG. 1 with the handle of the box shown in its nonuse position.
Figure 4:
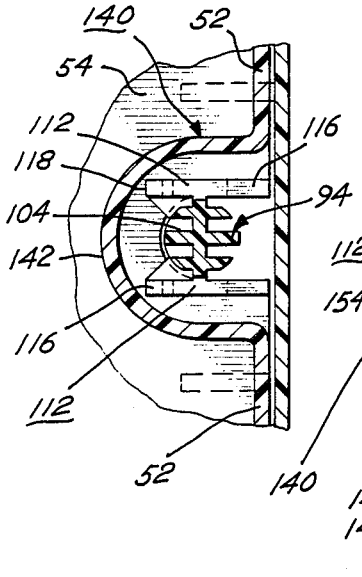
FIG. 4 is a cross-sectional view taken along the line 4—4 in FIG. 3.

As best illustrated in FIGS. 1–3, the front wall 20 of the body 12 includes an upper opening 30 and a lower opening 32. These openings 30 and 32 are spaced from one another vertically and extend from one side of the front wall to the other. They have the same basic dimensions.

An integral interior wall 34 defines the upper edge of the upper opening 30 and extends rearwardly from the front wall 20 to the rear wall 24. This wall 34, together with the upper portions of the side walls 16 and 18, the front wall 20, and the rear wall 24 serve to define an upper storage compartment 36 in the box 10.

The upper end of this compartment 36 is defined by the upper ends of the side walls 16 and 18, the front wall of 20, and the rear wall 24. These upper ends all terminate in a common horizontal plane and define an open upper end, shown generally at 38, for the body 12. Access to tools and the like stored in the upper compartment 36 may be readily had through the open upper end 38.

Molded plastic storage drawers 42 and 44 are disposed within the openings 30 and 32, respectively, in the front wall 20. The drawers 42 and 44 are identical in construction and are adapted to store tools and the like. Each has a front wall 46, which includes a central, recessed handle portion 48, side walls 50, a rear wall 52, and a bottom wall 54. Each also includes a plurality of integral interior walls 55 that serve to sub-divide the interior of the drawers into smaller storage compartments.

The storage drawers 42 and 44 are adapted to be slid, within and with respect to the body 12, between an open position where access to the tools and the like stored in the drawers may be had from without the box 10, such as shown in FIG. 2 and a closed position where the drawers are disposed completely within the box, such as shown in FIG. 1. The drawers may be slid or moved between their open and closed positions simply by grasping their handle portions 48 and pulling or pushing as the case may be. When the storage drawers are in their closed positions, their rear walls 52 are adjacent to the rear wall piece 26. Similarly, when the drawers 42 and 44 are in their closed positions, the dimensions of their front walls 46 are such that the walls 46 completely fills the openings 30 and 32, again as best shown in FIG. 1.

The edges of the body walls that define the side and lower edges of the opening 30 and that define the sides and both the upper and lower edges of the opening 32 extend rearwardly toward the plane of the rear wall 24. These rearwardly extending edges serve to support the front portions of the drawers 40 and 42.

A plurality of ribs 56 project upwardly from the bottom wall 22. These ribs 56 are integrally formed on the wall 22, are evenly spaced between the side walls 18 and 20 and are oriented in a front to rear direction. Similar projecting ribs 58 are integrally formed on the lower, forward extending portion of the rear wall piece 26 and are evenly spaced between the side walls 16 and 18. The upper edges of the ribs 56 and 58 are horizontally aligned with the plane of the lower edge of the opening 32. The ribs 56 and 58 serve to support the rear portion of the drawer 44 when that drawer is disposed within the body 12. Still other horizontally disposed, forwardly directed projections 60 are integrally formed on the rear wall piece 26. The upper edges of these projections 60 are horizontally aligned with the plane of the lower edge of the upper opening 30. The projections 60 serve to support the rear portion of the drawer 42 when that drawer is disposed within the body 12.

Referring now specifically to FIGS. 1–3 and 9–11, the lid 14 is connected with the body by a plurality of pairs of hinges 64. These hinges 64 are arranged so that the lid may be pivoted about a horizontal axis, adjacent to the upper edge of the rear wall 20, between a closed position, such as shown in FIG. 3, where the lid completely overlies and covers the open upper end 38 of the body 12 and a open position where the lid 14 is disposed at an angle with respect to the horizontal plane of the open upper end 38. When the lid is in its open position, ready access may be had to the tools and the like stored in the upper compartment 36 without the box.

Figure 10:
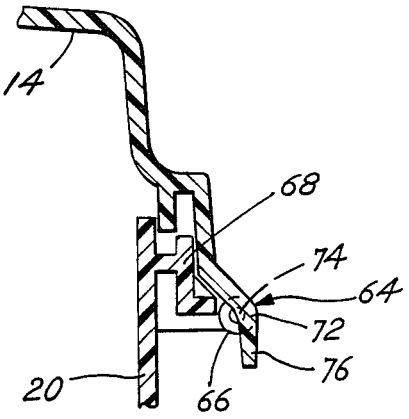
FIG. 10 is a cross-sectional view taken along the line 10—10 in FIG. 9 with the lid shown in its closed position.
Figure 11:
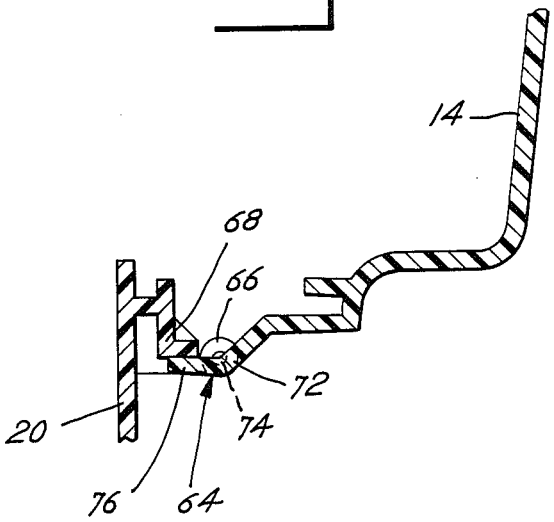
FIG. 11 is a view similar to that shown in FIG. 10 except that the lid is shown in its open position.

Except for their length, each of the hinges 64 are structurally identical. As best shown in FIGS. 10 and 11, each includes a first part 66 integrally formed on a projection 68 that, in turn, is integrally formed on the upper end of the rear wall 24. A complementary, cooperating hinge part 72 is integrally formed along the rear edge of the lid 14. Each of the parts 66 and 72 include horizontally disposed openings which when aligned, are adapted to receive a hinge pin 74. The hinge parts 66 and 72 cooperate with and pivot about the hinge pin 74 in a conventional manner. The hinge part 72 includes an integral extension which, as best illustrated in FIG. 11, is adapted to contact the projection 68 when the lid 14 has been moved through a predetermined maximum angle with respect to the plane of the open upper end 38. This angle is selected so that when fully opened, the lid 14 is substantially perpendicular to the horizontal plane of the open upper end 38 and can be maintained in its open position without the need to exert any additional force on the lid. An angle of ninety-two degrees has been found to provide satisfactory results in this regard. The advantage of including the projection 76, and thus limiting the angle that the lid may open, is that less space is required for the box when the box is being used on a crowded tool bench and the like in that the lid does not extend over and obscure other tools and materials on the bench. In other words, the tool box 10 requires sufficient space only for its body 12 when used on a crowded bench or the like.

A conventional "luggage-type" handle 78 is mounted in a recess 82 integrally formed in the central part of the lid 14. The ends of the handle 78 are adapted to pivot about a generally horizontal axis between a position, such as shown in FIG. 1, where the handle may be grasped to carry the box 10 and a position, such as shown in FIG. 3, where the handle 78 is, at least partially, within the recess 82 so as to be out of the way when not being used.

A pair of conventional latch assemblies 84 are mounted on the upper edge of the front wall 20 of the body 12. These assemblies 84 cooperate with locking projections 86, integrally formed on the lid 14, to latch the lid 14 in its closed position when desired.

Aligned forwardly projecting locking tabs 88 are integrally formed on the front edge of the lid 14 and on the upper edge of the front wall 20. These locking tabs are located midway between the side wall 16 and 18. They include aligned apertures adapted to receive a lock, such as a padlock, when the lid is in its closed position.

The novel locking assembly of the present invention is generally shown at 92 in FIGS. 2–8. This assembly includes a vertically disposed, molded plastic locking shaft 94 which is mounted adjacent to the rear wall 24 and the rear wall piece 26, midway between the side walls 16 and 18. The locking shaft 94 is molded from high impact polystyrene. It includes an upper end 96, a main body 98, and a lower end 102. Although the main body 98 is generally circular, in transverse or horizontal cross-section, the body 98 has a plurality of longitudinal grooves or slots 104 to facilitate its manufacture.

Figure 8:
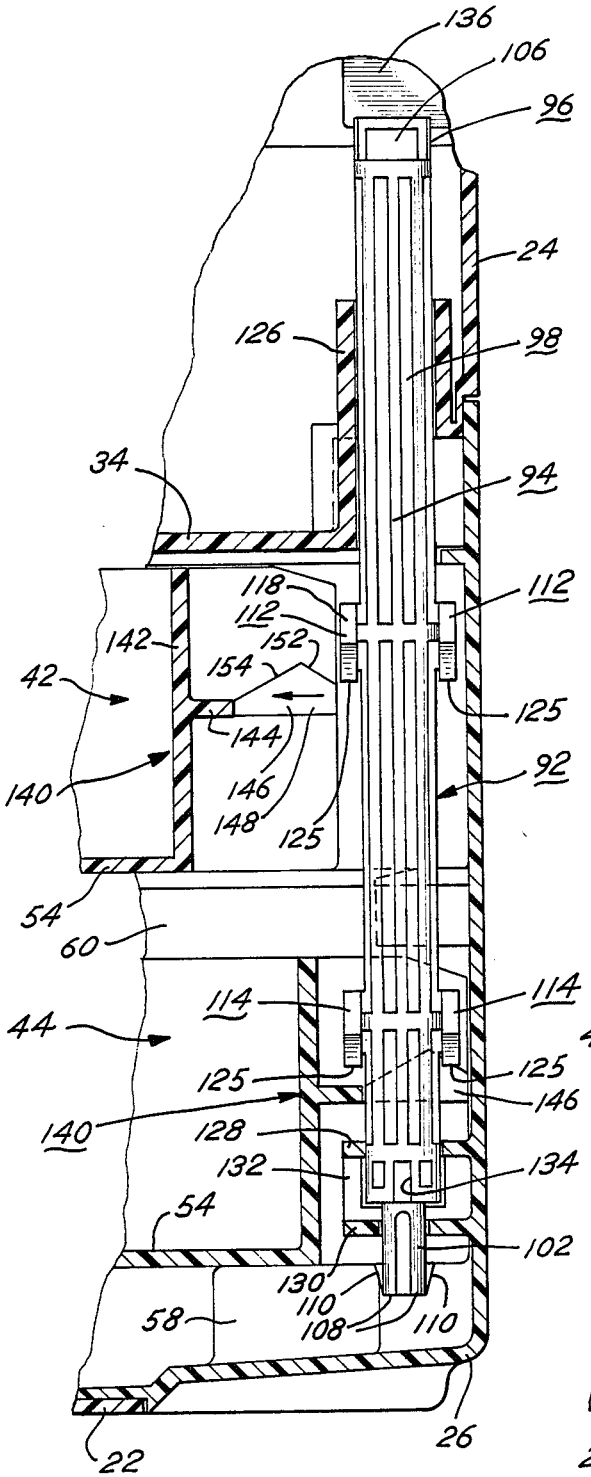
FIG. 8 is a view similar to that shown in FIG. 7 with the locking shaft being shown in its unlocked and upper positions and with the upper storage drawer being shown in a partially opened position.
Figure 7:
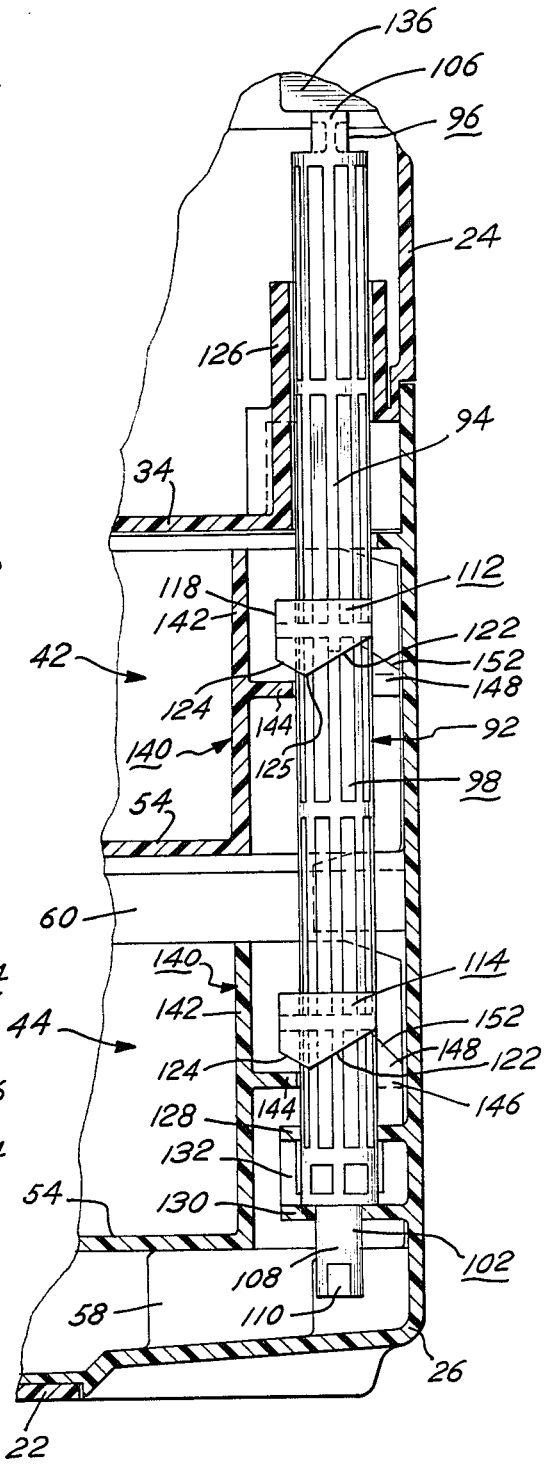
FIG. 7 is an enlarged, cutaway, partial elevational view of the rear central portion of the improved box of the present invention showing the locking shaft in its locked and lower positions.
Figure 9:
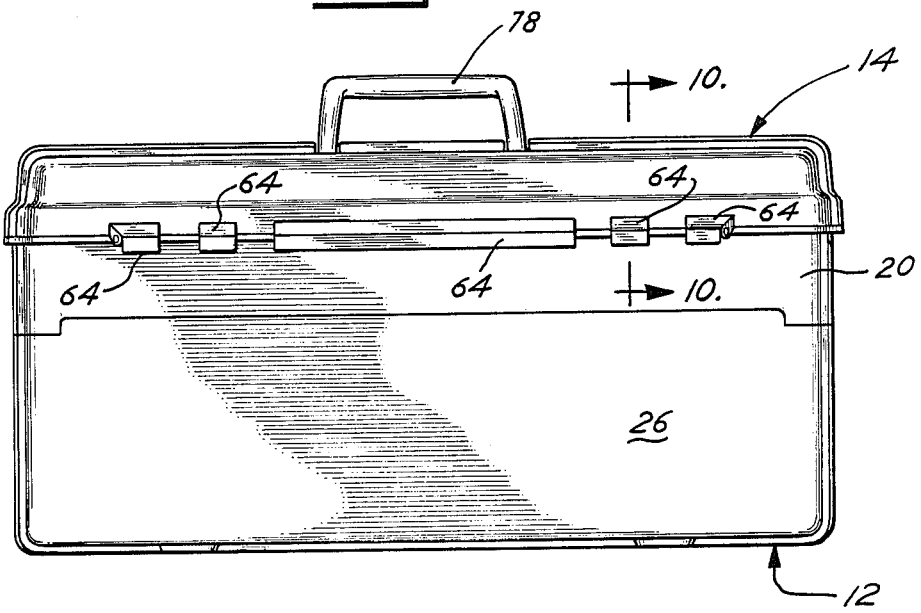
FIG. 9 is a rear elevational view of the improved molded plastic tool box of the present invention.

The upper end 96 of the locking shaft 94 is formed without two equal, opposed, segmental portions. The remaining upwardly projecting, central part 106, as best shown in FIGS. 7 and 8, has a transverse dimension, in one plane, substantially equal to the diameter of the main body 98 of the shaft 94 while in another plane, disposed 90 degrees from the first plane, the transverse dimension is substantially equal to that of the radius of the main body 98 of the shaft 94.

The lower end 102 of the locking shaft 94 is bifurcated as shown at 108. Due to the inherent resilience of the plastic material from which the shaft is formed, the bifurcated ends 108 may be bent slightly toward or away from each other. Each of the bifurcated ends 108 includes a integral, outwardly facing tab 110 for the reasons hereinafter explained.

Upper and lower pairs of locking abutments abutments 112 and 114 are integrally formed on the main body 98 of the locking shaft 94 at the two locations between the ends 96 and 102. The abutments 112 and 114 are generally horizontally aligned with the openings 30 and 32, respectively. Each of these pairs of locking abutments are disposed in a vertical plane perpendicular to a diameter of the locking shaft. Each abutment is spaced beyond the diameter of the shaft 94. The pairs of abutments 112 and 114 are aligned vertically with each other.

Each abutment in the pairs of abutments 112 and 114 are identical in structure and function. Each includes a horizontal upper facing surface 116, two vertically disposed, side surfaces 118, and two bottom facing, rear and front surfaces 122 and 124.

Each of the surfaces 122 and 124 of the abutments 112 and 114 are disposed at an angle with respect to the vertical and at an acute angle with respect to each other. They meet along a horizontal edge of intersection 125. The surfaces 122 and 124 serve as inclined planar surfaces in connection with the locking function performed by the locking assembly 92 as hereinafter described. The surface 122 is longer in length than the surface 124. The edge of intersection between the surface 122 and the adjacent side surface 118 is higher, vertically, than the edge of intersection between the surface 124 and its adjacent side surface 118.

As noted above, the locking shaft 94 is centrally mounted adjacent to the rear wall 24 and the rear wall portion 26. More specifically, the rear wall 24 includes an upper, integral annular mounting block 126 adjacent to and integral with the rear edge of the interior wall 34. The annular opening in the mounting block 126 is vertically disposed and is slightly larger, in diameter, than the diameter of the main body of the locking shaft 94. The mounting block 126 is adapted to receive the upper portion of the main body 98 when the shaft 94 is mounted in the body 12.

The lower wall piece 26 includes two central, horizontally disposed, forwardly projecting members 128 and 130. These members are vertically, relatively closely spaced and are aligned one above the other. The upper member 128 has a aperture formed therein which is slightly larger than the diameter of the main body 98 of the shaft 94. The lower member 130 has a opening formed therein that has a diameter substantially equal to the diameter of the lower end 102 of the shaft 94. The openings in the members 128 and 130 are co-axial. A thin, vertically disposed web 132 extends, front to rear, between the members 128 and 130. The web 132 generally bisects the openings in the members 128 and 130. The central, upper two-thirds of the web 132 is cut away so that the lower end of portions of the main body 98 can extend through the opening in the member 128 toward the member 130.

A pair of diametrically opposed slots 134, having a width slightly greater than the thickness of the web 132, are formed in the lower end of the main body 98. The vertical plane including these slots 134 is parallel to the vertical planes of the abutments 112 and 114. When the lower end 102 of the shaft 94 is disposed in the opening in the member 130 and the lower end of the main body 98 is disposed within the aperture in the member 128 and when the slots 134 are aligned with the web 132, the shaft 94 may be pushed downwardly to a lower position so that the adjacent parts of the web 132 extend into the slots 134 and the lower end of the main body 98 abuts the member 130 as best shown in FIG. 7. When in this position, the locking shaft 94 is prevented from rotating about its central longitudinal axis. The shaft 94 is then said to be in its locked and lower positions. When the shaft 94 is in this locked position, the planes of the abutments 112 and 114 are parallel to the side walls 16 and 18.

The locking shaft 94 may be moved upwardly from its lower to its upper position wherein the web 132 is no longer within the slots 134. The tabs 110 formed on the bifurcated tips 108 limit, as a practical matter, the distance that the shaft 94 may be moved upwardly, during normal usage, between its lower and upper positions. In this regard, tips 108 are inserted in the opening of the member 130 during the assembly by squeezing the tips together so that they and the tabs 110 may pass through the opening in the member 130.

The locking shaft 94 may be rotated about its central longitudinal axis. The permissible arc of rotation is limited to slightly more than ninety degrees because of contact between abutments 112 and 114 and the rear wall piece 26. When so rotated, as illustrated in FIG. 8, the shaft 94 is said to be in its unlocked and upper positions. When in its unlocked position, the planes of the abutments 112 and 114 are generally parallel to the front and rear walls 20 and 24. When the locking shaft 94 is rotated to and from its unlocked position, the lower end of the main body 98 rides or slides on the adjacent upper edge of the web 132.

As best shown in FIGS. 2, 3, 7 and 8, a pair of downwardly projecting flanges 136 are integrally formed on the lower facing surface of the lid 14. These flanges extend, from front to rear, when the lid 14 is in its closed position and project into the upper compartment 36. They are each equally spaced from the vertical plane, that includes the front to rear central axis of the body 12, distance approximately equal to the radius of the locking shaft 94. In other words, the spacing between the flanges 136 is slightly less or equal to the diameter of the shaft 94.

When the lid 14 is closed and when shaft 94 is rotated to its locked position (that is, where its upper end 96 is parallel to the rear wall 24) the lower edges of the flanges 136 contact the upper end 96. As noted, the slots 134 are aligned with the web 132 when the shaft 94 is in its locked position. The pressure of the lid being closed on the end 96, when the shaft 94 is in this locked position, will force the shaft down, and thus the slots 134 down over the web 132. When the lid 14 is latched or otherwise held in its closed position, the contact between the flanges 136 and the upper end 106 will prevent the shaft 94 from being moved from its lower position upwardly to its upper position. In other words, when the lid is closed and when the shaft 94 is in its locked position, the lid will hold the shaft 94 in its lower and locked positions.

Referring now particularly to FIGS. 3–8, both of the storage drawers 42 and 44 include a locking part 140 that cooperates with the abutments 112 and 114 on the shaft 94 and that comprises a component of the locking assembly 92. The locking part 140 of each of the drawers is structurally and functionally identical. More specifically, each locking part 140 is formed as an integral part of the rear wall 52 of its drawer and is located midway between the side walls 50 of the drawer. The part 140 includes an inwardly or frontwardly projecting smoothly curved wall 142 whose curved side projects toward the front wall 46 and which faces the rear wall piece 26. The curved wall 142 is symmetrical about the transverse, front to rear central axis of the drawer, is the same height as the rear wall 52, and forms a smooth, unbroken continuation of that wall 52.

A horizontally disposed platform 144 is formed within the area bounded by the curved vall 142. The plane of the platform 144 is parallel with the bottom wall 54 of the drawer but is spaced upwardly from that wall. The rear end of this platform 144 terminates at the plane of the back wall 52. A central, rear to front slot 146 is formed in the platform 144. The width and length of the slot 146 are such that the shaft 94 may be easily received within the slot and may be rotated when disposed in the slot. The dimensions of the curved wall 142 and the slot 146 are such that when the drawers 42 and 44 are disclosed completely within the body 12 (that is, are in their closed positions) the shaft 94 is, in turn, disposed within their respective slots 146, adjacent to the rear end edges of the slots.

A pair of vertical, upwardly extending locking abutments 148 are integrally formed on each of the platforms 144 of the drawers 42 and 44. The abutments 148 are formed on and along each side edge of the slot 146 and are disposed in vertical planes parallel to the side walls 50 of the drawers. They form a smooth continuation of the side edges of the slot and project above the plane of the platform 144.

Each of the abutments 148 is identical in structure and function. Each includes a first upwardly facing, incline planar surface 152 and a second upwardly facing, incline planar surface 154. The inclined planar surfaces 152 and 154 are disposed at an angle with respect to the vertical and with respect to each other, with the length of the surface 154 being longer than the length of the surface 152. The surface 152 is adjacent the rear wall piece 26. The surface 154 is disposed forwardly of the surface 152 and thus, is closer to the front wall 46 of the drawer.

The inclined planar surface 152 is generally the same length as the inclined planar surface 124 and is disposed at the same angle, with respect to the vertical, as the surface 124. Similarly, the inclined planar surface 154 is generally the same length as the inclined planar surface 122, and is disposed at the same angle, with respect to the vertical, as the surface 122. The pair of abutments 148 on each drawer are spaced apart a distance equal to the distance that the pairs of abutments 112 and 114 are spaced apart.

Figure 5:
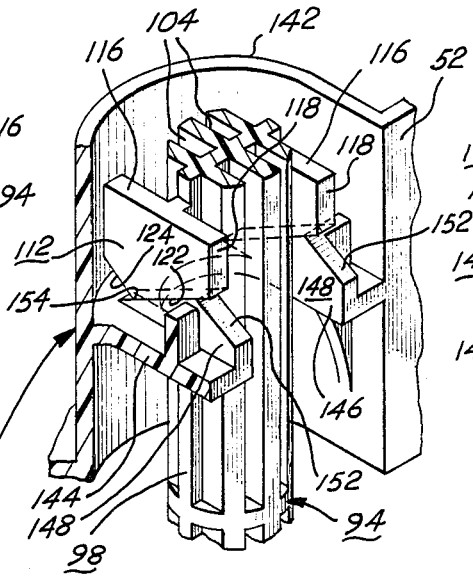
FIG. 5 is an enlarged, partial perspective view that shows the locking abutments on the locking shaft in engagement with the locking abutments on a storage drawer.
Figure 6:
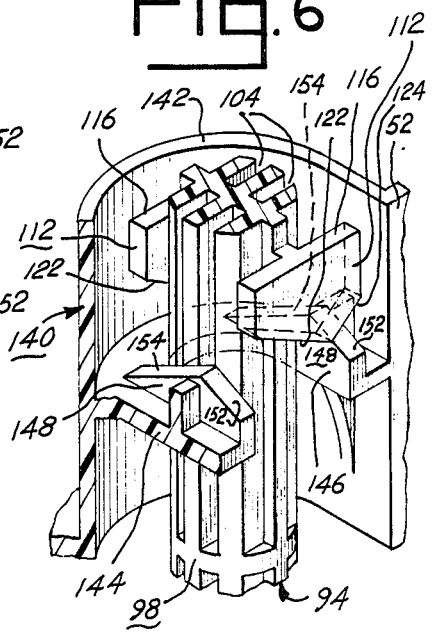
FIG. 6 is a partial perspective view, similar to that shown in FIG. 5, where the locking shaft is shown rotated to its unlocked position.

As best shown in FIGS. 5 and 7, when the locking shaft 94 is rotated to its locked position (that is, where the planes of the abutments 112 and 114 are parallel with the side walls 16 and 18) and when the drawers 42 and 44 are in their closed positions, the planar 122 on the abutments 112 and 114 are adapted to contact and engage the surfaces 154 on the abutments 148 on each of the drawers. When the shaft 94 is held in its lower position, as when the lid 14 is closed (that is, when the lower edges of the flanges 136 abut the upper end 96 of the shaft 94), the surface contact or engagement between the surfaces 122 and 154 prevent the drawers 42 and 44 from being moved from their closed position to their open position.

When the lid 14 is open so that the flanges 136 are not in contact with the upper end 96, the drawers 42 and 44 may be opened. For instance, when the drawer 42 is moved from its closed position to its open position, as by grasping its handle portion 48 and pulling, this causes corresponding relative movement along the surfaces 122 and 154 of the locking abutments 112 and 148. This relative movement, in turn, causes the shaft 94 to move upwardly from its lower position to its upper position. When the shaft 94 reaches its upper position, the abutments 148 may pass under the abutments 112 so that the drawer can be pulled forward to its open position.

When the lid 14 is open, the drawers 42 and 44 may be moved from their open positions to their closed positions by pushing them to the rear. As the drawers approach their closed positions, the inclined planar surfaces 152 on the abutments 148 come into surface to surface contact with the planar surfaces 124 on the abutments 112 and 114. Further rearward movement of the drawers causes relative sliding movement to occur between the surfaces 152 and 124, and thus causes the shaft 94 to move upwardly from its lower position to its upper position. As the drawers approach their closed position, the abutments 112, 114, 148, respectively ride up over the upper ends of the planar surfaces 152 and 124, and the surfaces 122 and 154 then come into surface-to-surface contact or engagement. Still further rearward movement of the drawers permits the shaft 94 to move, or to be moved, back down from its upper position to its lower position with the surfaces 122 and 154 in sliding engagement.

As noted before, if the shaft 94 is thereafter held in its locked and lower position, then the surface-to-surface engagement between the surfaces 122 and 154 will prevent forward relative movement between the drawers and the body 12. Similarly, the movement of the shaft 94 from its upper to lower positions causes the web 132 to be received within the slots 134. This, as noted, prevents rotation of the shaft 94, about its central longitudinal axis, away from its locked position.

When the shaft 94 is rotated ninety degrees from its locked position to its unlocked position (that is, to the position shown in FIGS. 6 and 8), the locked abutments 112 and 114 are disposed in planes parallel to the front and rear walls 20 and 24 and transverse to the planes of the locking abutments 148. The shaft 94 is in its upper position since the slots 134 are not aligned with the web 132. Accordingly, there is no contact or engagement between the abutments 112, 114 and 148, and the drawers 42 and 44 may be readily moved between their closed and opened positions. To return the shaft 94 to its locked position, the shaft need only be rotated back through the ninety degree arc from the position shown in FIG. 8 to the position shown in FIG. 7 so that the planes of the abutments 112 and 114 are again parallel to and coaxial with the planes of the abutments 148.

In conclusion, the invention described herein may be embodied in other specific forms without departing from the spirit or central characteristics thereof. The preferred embodiment described hereinabove is therefore, to be considered in all respects as illustrative and not restrictive. The scope of the invention is indicated by the appended claims rather than by the foregoing description. All changes which come within the meaning and range of equivalency of the claims are therefore intended to be embraced therein.

We claim:

1. An improved molded plastic box for storing and transporting tools and the like comprising:

a body including a front wall, side walls, a rear wall, a bottom wall, and an open upper end that permits access into the interior of the body, with the front wall of the body having an opening therein;

a lid adapted to overlie and cover the open upper end of the body;

means for connecting the lid with the body so that the lid may be selectively moved between an open position where access may be had to the interior of the body through the open upper end of the body and a closed position where the lid overlies and covers the open upper end of the body;

a drawer adapted to be slidingly received within the opening in the front wall and to be selectively movable, in a generally horizontal plane, between an open position where a portion of the drawer extends out of the body so as to permit access to the interior of the drawer from without the body and a closed position where the drawer is disposed within the body;

means for locking the drawer in its closed position, with the locking means being selectively movable between: a first position where the locking means cooperates with the drawer and the lid to lock the drawer is in its closed position when the lid is in the closed position, and a second position where the locking means allows the drawer to be moved between its closed and open positions when the lid is in the closed position; wherein the means for locking further allows the drawer to move between its open and closed positions when the lid is in the open position when the locking means is either in the first or second positions; wherein the locking means includes a vertically disposed shaft mounted in the box, with the upper end of the shaft being adjacent to the upper end of the box and the lower end of the shaft being disposed below the horizontal plane; wherein the shaft may be rotated about its central longitudinal axis; and wherein rotation of the shaft moves the shaft between its locking position and its unlocking position; wherein the shaft may also be moved up and down, parallel to its central longitudinal axis, between a lower position and an upper position; wherein the portion of the drawer includes a first locking abutment; wherein the shaft includes a second locking abutment that is adapted to be engaged by the first locking abutment when the shaft is in its locked position and the drawer is in its closed position; and wherein the lid portion contacts the upper end of the shaft when the lid is in its closed position and the shaft is in its locked position so as to maintain the shaft in its lower position and, when the drawer is in its closed position, so as to maintain an engagement between the first and second locking abutment that prevents the drawer from between being moved from its closed position.

2. The improved box of claim 1 wherein the lid connecting means includes at least one pair of cooperating hinges, with one portion of the pair of hinges being integrally formed on the lid and with the other mating portion of the pair of hinges being integrally formed on the rear wall of the body; and wherein the one portion includes an extended projection that is adapted to contact the rear wall of the body so as to limit the lid from being opened through more than a predetermined angle with respect to the plane of the open upper end of the box.

3. The improved box of claim 1 wherein when the shaft is rotated so that the locking means is in its unlocked position, the first and second abutments are not in engagement when the drawer is in its closed position so that the drawer may be moved between its closed and opened positions when the lid is both in its open position and in its closed position.

4. The improved box of claim 1 wherein each of the first and second abutments have a first vertical directed inclined planar surface; wherein the first inclined planar surfaces are in surface-to-surface contact so as to be able to cooperate with each other when the first and second abutments are in engagement; wherein when the lid is in its open position and the drawer is in its closed position, the shaft may move from its lower position to its upper position and movement of the drawer from its closed position toward its open position causes relative movement between the first and second abutments, along the first inclined planar surfaces, so that the shaft moves upwardly from its lower position to its upper position as the first abutment is moved past the second abutment.

5. The improved box of claim 4 wherein when the shaft has been rotated so that the shaft is in its unlocked position, the lid portion does not contact the upper end of the shaft when the lid is in its closed position, the first and second abutments are not in engagement, and the first inclined planar surfaces are not in surface-to-surface contact when the drawer is in its closed position so that the drawer may be moved between its closed and opened positions when the lid is both in its open position and in its closed position.

6. The improved box of claim 5 wherein each of the first and second abutments have a second vertically directed inclined planar surface; wherein when the shaft is in its locked position, when the lid is in its open position, and when the drawer is moved so that as the drawer approaches its closed position, the second inclined planar surfaces come into surface-to-surface contact and permit the first abutment to be moved past the second abutment as the shaft is moved upwardly from its lower position to its upper position.

7. The improved box of claim 6 which includes means for preventing rotation of the shaft when the shaft is in its lower position and when the shaft is in its locked position.

8. The improved box of claim 7 wherein the body includes means for supporting the shaft during its rotational and vertical movements; wherein the shaft is disposed adjacent the rear wall of the body, midway between the side walls of the body; and wherein the upper end of the shaft is accessible and may be grasped for selectively causing rotational and vertical movement of the shaft when the lid is in its open position.

9. The improved box of claim 6 wherein the body includes means for supporting the shaft during its rotational and vertical movements; and wherein the shaft is disposed adjacent the rear wall of the body, midway between the side walls of the body.

10. The improved box of claim 6 wherein the upper end of the shaft is accessible and may be grasped for selectively causing rotational movement of the shaft between its locked and unlocked positions and vertical movement of the shaft between upper and lower positions when the lid is in its open position.

11. The improved box of claim 4 wherein each of the first and second abutments have a second vertically directed inclined planar surface; wherein when the shaft is in its locked position and when the drawer is moved so that as the drawer approaches its closed position, the second inclined planar surfaces come into surface-to-surface contact and permit the first abutment to be moved past the second abutment as the shaft is moved upwardly from its lower position to its upper position.

* * * * *